US006814554B1

(12) United States Patent
Chang et al.

(10) Patent No.: US 6,814,554 B1
(45) Date of Patent: Nov. 9, 2004

(54) VORTEX COMPRESSOR

(75) Inventors: Lung-Tsai Chang, Taoyuan Hsien (TW); Guang-Der Tarng, Taoyuan Hsien (TW)

(73) Assignee: Rechi Precision Co., Ltd., Taoyuan Hsien (TW)

( * ) Notice: Subject to any disclaimer, the term of this patent is extended or adjusted under 35 U.S.C. 154(b) by 0 days.

(21) Appl. No.: 10/453,619

(22) Filed: Jun. 4, 2003

(51) Int. Cl.[7] ..... F04C 18/00

(52) U.S. Cl. ..... 418/55.1; 418/55.5; 418/57; 418/55.2

(58) Field of Search ..... 418/55.1, 55.2, 418/55.5, 57

(56) References Cited

U.S. PATENT DOCUMENTS 4,649,611 A * 3/1987 Ikeda et al. ..... 418/55.1
4,655,697 A * 4/1987 Nakamura et al. ..... 418/55.4
5,599,178 A * 2/1997 Yuzaki et al. ..... 418/55.1
6,039,549 A * 3/2000 Tarng et al. ..... 418/55.5
6,241,495 B1 * 6/2001 Chang ..... 418/55.5
6,345,966 B1 * 2/2002 Hahn et al. ..... 418/55.1

* cited by examiner

*Primary Examiner*—Theresa Trieu
(74) *Attorney, Agent, or Firm*—Troxell Law Office PLLC

(57) ABSTRACT

An improved structure of vortex compressor provided with at least one threaded hole to the positioning pillar of a frame, a retainer packing locked with the screw to the frame to define an ideal spacing between the pillar and a vortex seat, and the ideal spacing being limited in position by the packing to restrict the vortex seat characterized by a deformation spacing slightly larger than the diameter of that of the prior art being provided to the threaded hole on the inner edge at the end receiving the screw to absorb squeezing produced by placement of the screw for quality assurance of the assembly of the vortex seat while eliminating the flaws of narrowing spacing of revolution between deformed positioning pillar and vortex seat or operation noise and awkward operation due to unpredictable change.

1 Claim, 4 Drawing Sheets

VORTEX COMPRESSOR

BACKGROUND OF THE INVENTION (a) Field of the Invention

The present invention is related to an improved fixation structure between vortex sea and frame in vortex compressor, and more particularly, to one that achieves quality assurance of the assembly of the vortex seat by reducing improper squeezing between screw and threaded hole of the positioning pillar that prevents screw from being placed into threaded hole, and that eliminates the flaws of narrowing spacing of revolution between deformed positioning pillar and vortex seat or operation noise and awkward operation due to unpredictable change.

(b) Description of the Prior Art

As illustrated in FIG. 1 of the accompanying drawings, a fixation structure for a vortex seat in a vortex compressor of the prior art has its interior of a casing of the vortex compressor divided into a low-pressure chamber and a high-pressure chamber by a separation block (30), and a vortex seat (10) and a revolving vortex (20) are provided below the separation block (30). Wherein, the vortex seat (10) is fixed to a frame (40) while the revolving vortex (20) as driven by a spindle (not illustrated) of the compressor to revolve inside the vortex (10) without revolving on its own axis so to change the cubic capacity of the space between the vortex seat (10) and the revolving vortex (20) for exercising suction and compression on the coolant entering into the low-pressure chamber to change the volume of the coolant, thus for the coolant to carry on heat exchange in cycle between coolant pipe and compressor.

In addition to placing the vortex seat (10), the frame (40) provides support and coupling purposes for the revolving vortex (20), spindle and other related members. The vortex seat (10) is placed on the upper end of the frame (40) only upon the support assembly for other members (including the revolving vortex) by the frame as illustrated in FIG. 2. Therefore, the assembly structure between the vortex seat (10) and the frame (40) of the prior art is to provide at least one threaded hole (51) in a positioning pillar (41) of the frame (40) and a retainer packing (70) is locked to the frame with a screw (60) to define an ideal spacing (A) between the positioning pillar (41) of the frame (4) and the vortex seat (10), limited in position by the vortex seat (10), which is restricted by the retainer packing (70).

Whereas the spacing between the frame (40) and the retainer packing (70) is coupled by the locking effect exercised by the screw (60), a comparatively greater force is necessary to drive the screw (60) into the threaded hole (51) to lock up the frame (40) and the retainer packing (70). Usually the excessive force affects the assembly precision of other members and the positioning pillar (41) is deformed due to the squeezing by the screw (60) and the threaded hole (51) as illustrated in FIG. 2, thus to further affect the ideal spacing (A) between the vortex seat (10) and the positioning pillar (41) resulting in noise produced during operation of the compressor or in the awkward operation of the compressor.

SUMMARY OF THE INVENTION

The primary purpose of the present invention is to provide an improved structure of vortex compressor. To achieve the purpose at least one threaded hole is provided to the positioning pillar of a frame, a retainer packing locked with the screw to the frame to define an ideal spacing between the pillar and a vortex seat, and the ideal spacing is limited in position by the packing that restricts the vortex seat. A deformation spacing slightly larger than the diameter of that of the prior art being provided to the threaded hole on the inner edge at the end receiving the screw to absorb squeezing produced by placement of the screw for quality assurance of the assembly of the vortex seat while eliminating the flaws of narrowing spacing of revolution between deformed positioning pillar and vortex seat or operation noise and awkward operation due to unpredictable change.

DETAILED DESCRIPTION OF THE PREFERRED EMBODIMENTS

Same as the prior art, a separation block is used to divide the space inside the casing of the compressor into a low-pressure chamber and a high-pressure chamber. A vortex seat and a revolving vortex are provided below the separation block on one side of the low-pressure chamber. Wherein, the vortex seat is fixed to a frame while the revolving vortex as driven by a spindle of the compressor to revolve inside the vortex without revolving on its own axis so to change the cubic capacity of the space between the vortex seat and the revolving vortex for exercising suction and compression on the coolant entering into the low-pressure chamber to change the volume of the coolant, thus for the coolant to carry on heat exchange in cycle between coolant pipe and compressor.

Figure 4:
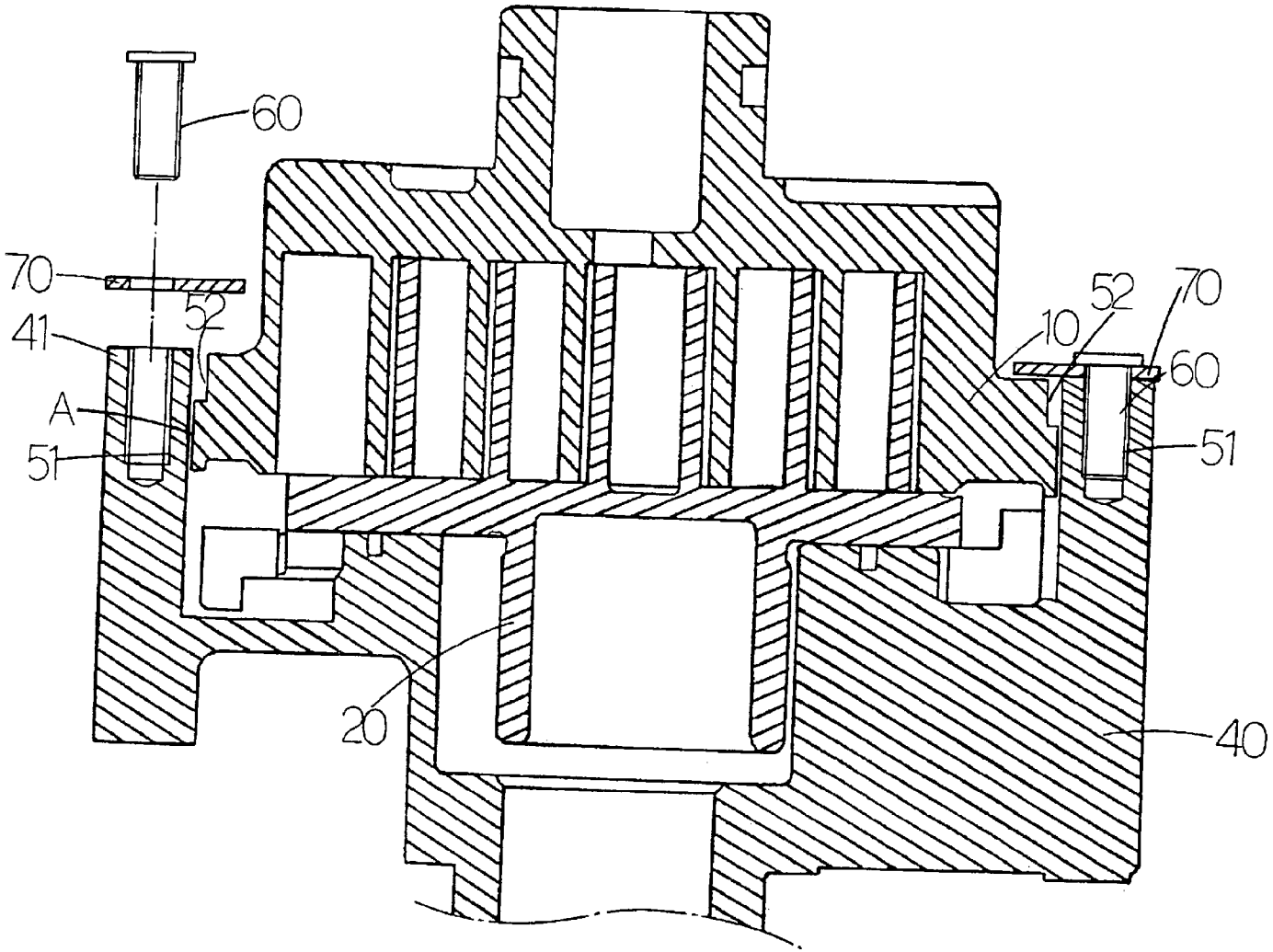
FIG. 4 is a sectional view showing a structure between a vortex seat and a frame of another preferred embodiment of the present invention.

Now referring to FIG. 4, at least one threaded hole (51) is provided to a positioning pillar (41) of a frame (40), and a retainer packing (70) is locked with a screw (60) to the frame (40) to define an ideal spacing (A) between the positioning pillar (41) and a vortex seat (10), with the ideal spacing (A) being limited in position by the retainer packing (70) that is restricts the vortex seat (10).

Figure 1:
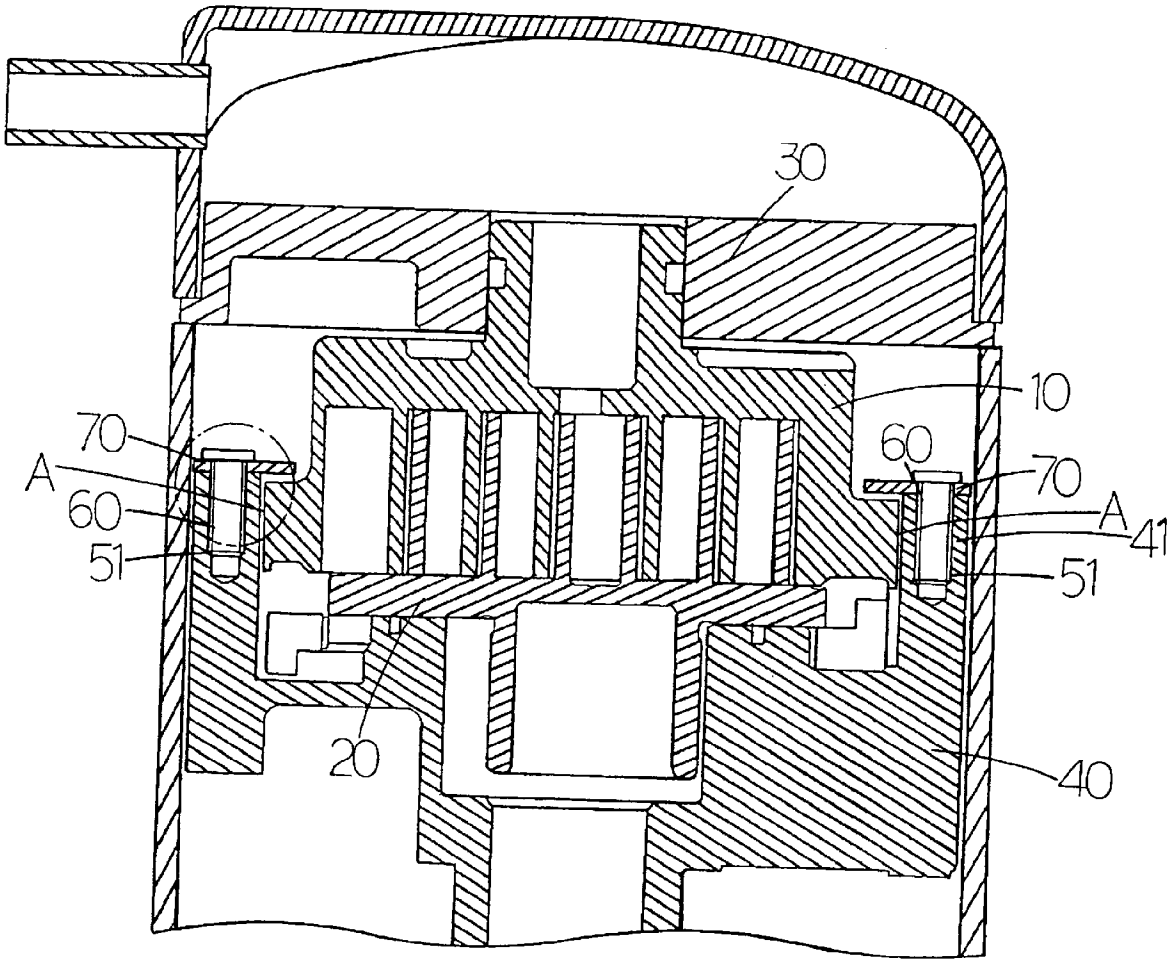
FIG.1 Prior Art
FIG. 1 is a schematic view showing a fixation structure for a vortex seat in a vortex compressor of the prior art.
Figure 2:
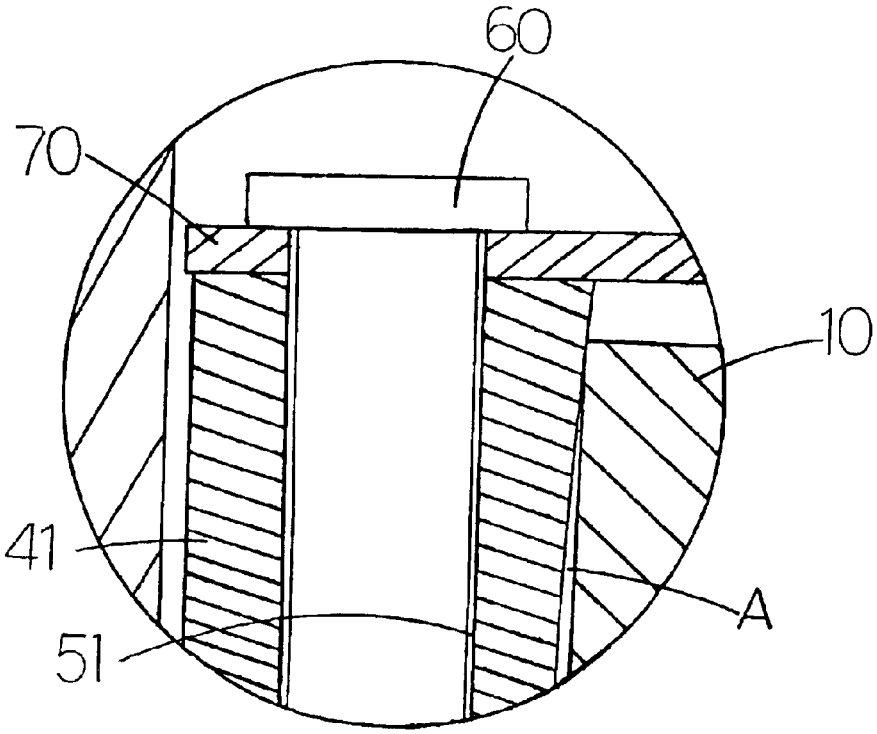
FIG.2 Prior Art
FIG. 2 is a sectional view showing a structural deformation between the vortex seat and a frame of the vortex compressor of the prior art.
Figure 3:
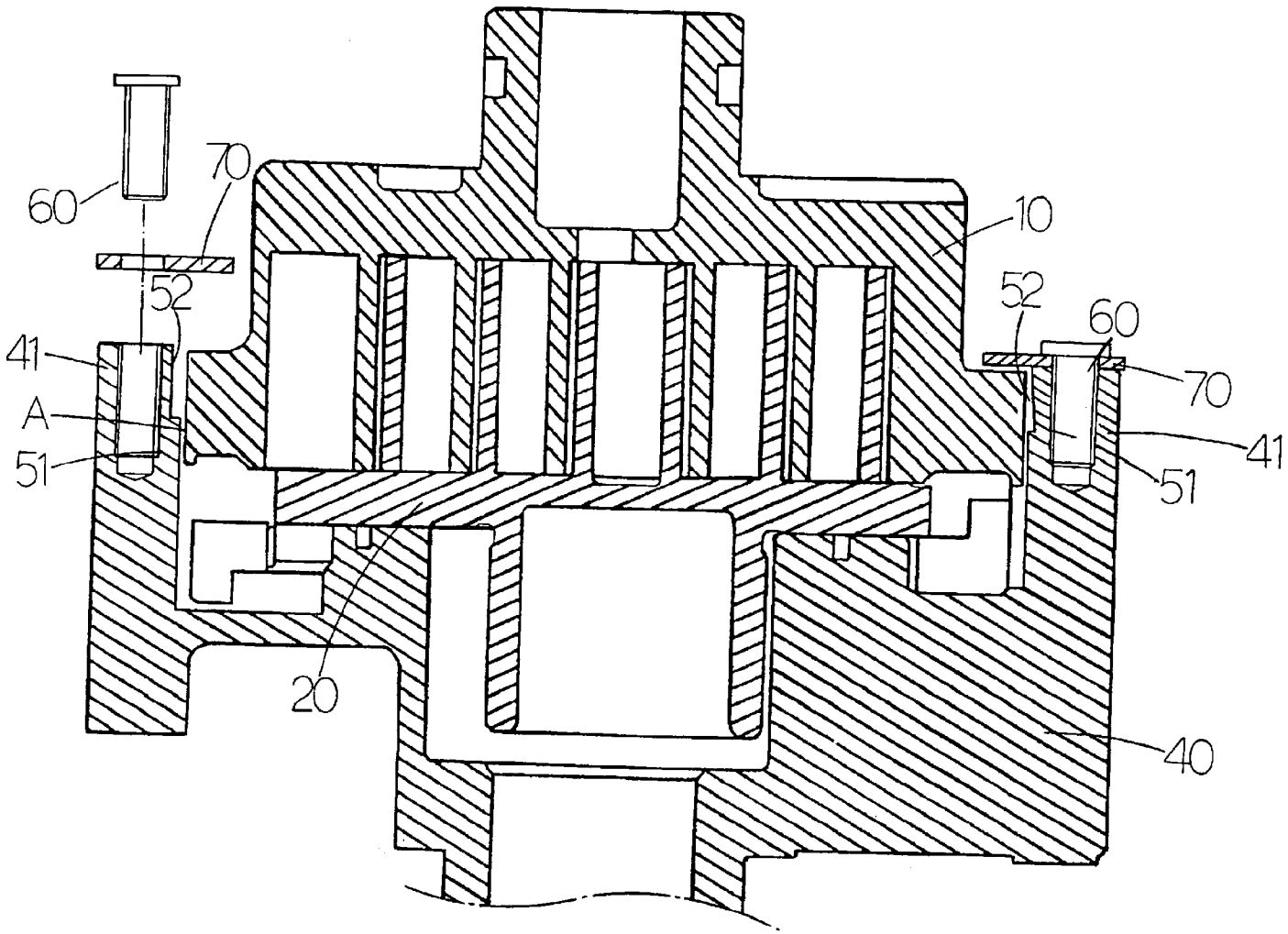
FIG. 3 is a sectional view showing a structure between a vortex seat and a frame of a preferred embodiment of the present invention.

As illustrated in FIG. 3, on the inner edge at where to receive the placement of the screw (60) of the threaded hole (51) to the frame (40) is provided with a deformation spacing (52) in a diameter slightly larger than that of the prior art. Upon assembling of the frame (40) and the retainer packing (70), the screw (60) is easily received into the threaded hole (51) through the deformation spacing (52) to provide the locking effect in the threaded hole (51) as required, thus to fix the retainer packing (70) to the frame (4) for quality assurance of the assembly of the vortex seat (10). The installation of the deformation spacing (52) also effectively eliminates flaws of narrowing spacing of revolution between deformed positioning pillar (41) and the vortex seat (10) or operation noise and awkward operation of the compressor due to unpredictable change.

The deformation spacing (52) can also be provided at the inner edge on the vortex seat (10) in relation to one end of threaded hole (51) that receives the placement of the screw (60).

The present invention for an improved the fixation structure for a vortex compressor provides an effective way to reduce the squeezing produced by the screw against the threaded hole in the process of assembling the screw for quality assurance of the assembly of the vortex seat. Therefore, an application for a utility patent is duly filed accordingly. However, it should be known that preferred embodiments and accompanying drawings of the present invention are provided not to limit the present invention, and any structure, device, characteristics that are identical with or similar to that of the present invention shall be deemed as falling within the scope of the purpose and the claim of the present invention.

We claim:

1. A structure of vortex compressor comprising: at least one threaded hole provided in a positioning pillar of a frame; a retainer packing is locked to the frame with a screw, an ideal spacing is defined between the positioning pillar of the frame a vortex seat, and the ideal spacing being limited in position by the retainer packing that restricts the vortex seat, wherein, upon assembling of the frame and the retainer packing, the screw is easily received into the threaded hole through a deformation spacing to provide a locking effect in the threaded hole as required, thus to fix the retainer packing to the frame for quality assurance of the assembly of the vortex seat; the installation of the deformation spacing also effectively eliminates flaws of narrowing spacing of revolution between deformed positioning pillar and the vortex seat or operation noise and awkward operation of the compressor due to unpredictable change, wherein the deformation spacing is formed on the vortex seat in relation to an inner edge at an end of the threaded hole to receive the placement of the screw for facilitating the placement of the screw into the threaded hole, and for providing the locking effect when the screw is completely received in the threaded hole for quality assurance of the assembly of the vortex seat.

* * * * *